US007856847B2

(12) United States Patent
Patel et al.

(10) Patent No.: US 7,856,847 B2
(45) Date of Patent: Dec. 28, 2010

(54) MULTIPLE REFLUX STREAM HYDROCARBON RECOVERY PROCESS

(75) Inventors: Sanjiv N. Patel, Sugar Land, TX (US); Jorge H. Foglietta, Missouri City, TX (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 12/345,829

(22) Filed: Dec. 30, 2008

(65) Prior Publication Data

US 2009/0113930 A1 May 7, 2009

Related U.S. Application Data

(62) Division of application No. 10/756,196, filed on Jan. 13, 2004, now Pat. No. 7,484,385.

(60) Provisional application No. 60/440,538, filed on Jan. 16, 2003.

(51) Int. Cl.
*F25J 3/00* (2006.01)

(52) U.S. Cl. ..... 62/620

(58) Field of Classification Search ..... 62/620, 62/618, 632, 635; 95/225, 228
See application file for complete search history.

(56) References Cited

U.S. PATENT DOCUMENTS 4,486,209 A 12/1984 Fabbri et al.
4,519,824 A 5/1985 Huebel
4,657,571 A 4/1987 Gazzi
4,687,499 A 8/1987 Aghili
4,851,020 A 7/1989 Montgomery, IV
5,568,737 A 10/1996 Campbell et al.
5,881,569 A 3/1999 Campbell et al.
5,890,377 A 4/1999 Foglietta
6,116,050 A 9/2000 Yao et al.
6,182,469 B1 2/2001 Campbell et al.
6,244,070 B1 6/2001 Lee et al.
6,363,744 B2 4/2002 Finn et al.
6,453,698 B2 9/2002 Jain et al.
6,516,631 B1 2/2003 Trebble
7,316,127 B2 * 1/2008 Huebel et al. ..... 62/625
2003/0029190 A1 2/2003 Trebble

* cited by examiner

*Primary Examiner*—Melvin Jones
(74) *Attorney, Agent, or Firm*—Alix, Yale & Ristas, LLP

(57) ABSTRACT

An ethane recovery process utilizing multiple reflux streams is provided. Feed gas is cooled, partially condensed, and separated into a first liquid stream and a first vapor stream. First liquid stream is expanded and sent to a demethanizer. First vapor stream is split into a first and a second separator vapor streams. First separator vapor stream is expanded and sent to demethanizer. Second separator vapor stream is partially condensed and is separated into a reflux separator liquid stream, which is sent to demethanizer, and a reflux separator vapor stream, which is condensed and sent to demethanizer. Demethanizer produces a tower bottom stream containing a substantial amount of ethane and heavier components, and a tower overhead stream containing a substantial amount of remaining lighter components and forms a residue gas stream. A portion of residue gas stream is cooled, condensed, and sent to the demethanizer tower as top reflux stream.

4 Claims, 7 Drawing Sheets

MULTIPLE REFLUX STREAM HYDROCARBON RECOVERY PROCESS

RELATED APPLICATIONS

This application is a Divisional of U.S. patent application Ser. No. 10/756,196, filed on Jan. 13, 2004, now U.S. Pat. No. 7,484,385 entitled "Multiple Reflux Stream Hydrocarbon Recovery Process", which, in turn claims priority to U.S. Provisional Patent Application Ser. No. 60/440,538 filed on Jan. 16, 2003, entitled "Multiple Reflux Stream Hydrocarbon Recovery Process", each of which is hereby expressly incorporated by reference in its entirety as part of the present disclosure.

BACKGROUND OF THE INVENTION

1. Technical Field of Invention

The present invention relates to the recovery of ethane and heavier components from hydrocarbon gas streams. More particularly, the present invention relates to recovery of ethane and heavier components from hydrocarbon streams utilizing multiple reflux streams.

2. Description of Prior Art

Valuable hydrocarbon components, such as ethane, ethylene, propane, propylene and heavier hydrocarbon components, are present in a variety of gas streams. Some of the gas streams are natural gas streams, refinery off gas streams, coal seam gas streams, and the like. In addition these components may also be present in other sources of hydrocarbons such as coal, tar sands, and crude oil to name a few. The amount of valuable hydrocarbons varies with the feed source. The present invention is concerned with the recovery of valuable hydrocarbon from a gas stream containing more than 50% methane and lighter components [i.e., nitrogen, carbon monoxide (CO), hydrogen, etc.], ethane, and carbon dioxide ($CO_2$). Propane, propylene and heavier hydrocarbon components generally make up a small amount of the overall feed. Due to the cost of natural gas, there is a need for processes that are capable of achieving high recovery rates of ethane, ethylene, and heavier components, while lowering operating and capital costs associated with such processes. Additionally, these processes need to be easy to operate and be efficient in order to maximize the revenue generated form the sale of NGL.

Several processes are available to recover hydrocarbon components from natural gas. These processes include refrigeration processes, lean oil processes, refrigerated lean oil processes, and cryogenic processes. Of late, cryogenic processes have largely been preferred over other processes due to better reliability, efficiency, and ease of operation. Depending of the hydrocarbon components to be recovered, i.e. ethane and heavier components or propane and heavier components, the cryogenic processes are different. Typically, ethane recovery processes employ a single tower with a reflux stream to increase recovery and make the process efficient such as illustrated in U.S. Pat. No. 4,519,824 issued to Huebel (hereinafter referred to as "the '824 patent"); U.S. Pat. No. 4,278,457 issued to Campbell et al.; and U.S. Pat. No. 4,157,904 issued to Campbell et al. Depending on the source of reflux, the maximum recovery possible from the scheme may be limited. For example, if the reflux stream is taken from the hydrocarbon gas feed stream or from the cold separator vapor stream, or first vapor stream, as in the '824 patent, the maximum recovery possible by the scheme is limited because the reflux stream contains ethane. If the reflux stream is taken from lean residue gas stream, then 99% ethane recovery is possible due to the lean composition of the reflux stream. However, this scheme is not very efficient due to the need to compress residue gas for reflux purposes.

A need exists for a process that is capable of achieving high ethane recovery, while maintaining its efficiency. It would be advantageous if the process could be simplified so as to minimize capital costs associated with additional equipment.

SUMMARY OF INVENTION

The present invention advantageously includes a process and apparatus to decrease the compression requirements for residue gas while maintaining a high recovery yield of ethane ("C2+") components from a hydrocarbon gas stream by using multiple reflux streams.

First, a hydrocarbon feed stream is split into two streams, a first inlet stream and a second inlet stream. First inlet stream is cooled in an inlet gas exchanger, and second inlet stream is cooled in one or more demethanizer reboilers of a demethanizer tower. The two streams are then directed into a cold separator. When the hydrocarbon feed stream has an ethane content above 5%, a cold absorber can be used to recover more ethane. If a cold absorber is used, the colder stream of two streams is introduced at a top of the cold absorber and the warmer stream is sent to a bottom of the cold absorber. The cold absorber preferably includes at least one mass transfer zone.

Cold separator produces a separator overhead stream and a separator bottoms stream. Cold separator bottoms stream is directed to methanizer as a first demethanizer feed stream while cold separator overhead stream is split into two streams, a first cold separator overhead stream and a second cold separator overhead stream. First cold separator overhead stream is sent to an expander and then to demethanizer as a second demethanizer feed stream. Second cold separator overhead stream is cooled and then sent to a reflux separator.

In an alternate embodiment, inlet gas stream is split into three streams, wherein first and second streams continue to be directed to front end exchanger and demethanizer reboilers, respectively. A third stream is cooled in the inlet gas exchange and a reflux subcooler before being sent to reflux separator. Furthermore, in this embodiment, cold separator overhead stream is not split into two streams, but, instead, is maintained as a single stream. Cold separator overhead stream is expanded and then fed into demethanizer as a second demethanizer feed stream.

Similar to cold separator, reflux separator also produces a reflux separator overhead stream and a reflux separator bottoms stream. Reflux separator bottoms stream is directed to demethanizer as third demethanizer feed stream. After exiting reflux separator, reflux separator overhead stream is cooled, condensed, and sent to demethanizer as a fourth demethanizer feed stream.

The demethanizer tower is preferably a reboiled absorber that produces an NGL product containing a large portion of ethane, ethylene, propane, propylene and heavier components at the bottom and a demethanizer overhead stream, or cold residue gas stream, containing a substantial amount methane and lighter components at the top. Demethanizer overhead stream is warmed in the reflux exchanger and then in the inlet gas exchanger. This warmed residue gas stream is then boosted in pressure across the booster compressor, and then compressed to pipeline pressure to produce a residue gas stream. A portion of the high pressure residue gas stream is cooled, condensed, and sent to the demethanizer tower as a top feed stream, or a demethanizer reflux stream. Alternatively, demethanizer reflux stream is cooled in the inlet gas exchanger, combined with a portion of second cold separator overhead stream, partially condensed in reflux exchanger, and then fed into reflux separator.

In an additional alternate embodiment, wherein inlet gas stream is split into three streams, third inlet gas stream is combined with residue gas reflux stream. This combined inlet/recycle stream is cooled in both inlet gas exchanger and reflux subcooler. In this embodiment, cold separator overhead stream is not split into two streams, but instead is expanded and then fed into demethanizer as second demethanizer feed stream.

Demethanizer produces at least one reboiler stream that is warmed in demethanizer reboiler and redirected back to demethanizer as return streams to supply heat and recover refrigeration effects from demethanizer. In addition, demethanizer also produces a demethanizer overhead stream and a demethanizer bottoms stream wherein demethanizer bottoms stream contains major portion of recovered C2+ components. While the recovery of C2+ components is comparable to other C2+ recovery processes, the compression requirements are much lower.

BRIEF DESCRIPTION OF DRAWINGS

So that the manner in which the features, advantages and objectives of the invention, as well as others that will become apparent, are attained and can be understood in detail, more particular description of the invention briefly summarized above may be had by reference to the embodiments thereof that are illustrated in the drawings, which drawings form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF DRAWINGS

For simplification of the drawings, figure numbers are the same in FIGS. 3, 4, 5, 6, and 7 for the various streams and equipment when functions are the same, with respect to streams or equipment, in each of the figures. Like numbers refer to like elements throughout, and prime, double prime, and triple prime notation, where used, generally indicate similar elements in alternate embodiments.

As used herein, the term "inlet gas" means a hydrocarbon gas, such gas is typically received from a high pressure gas line and is substantially comprised of methane, with the balance being ethane, ethylene, propane, propylene, and heavier components as well as carbon dioxide, nitrogen and other trace gases. The term "C2+ compounds" means all organic components having at least two carbon atoms, including aliphatic species such as alkanes, olefins, and alkynes, particularly, ethane, ethylene, acetylene and like.

In order to illustrate the improved performance that is achieved using the present invention, similar process conditions were simulated using prior art processes described herein and embodiments of the present invention. The composition, flowrates, temperatures, pressures, and other process conditions are for illustrative purposes only and are not intended to limit the scope of the claims appended hereto. The examples can be used to compare the performances of the present invention and the prior art processes under similar conditions.

PRIOR ART EXAMPLE

Figure 1:
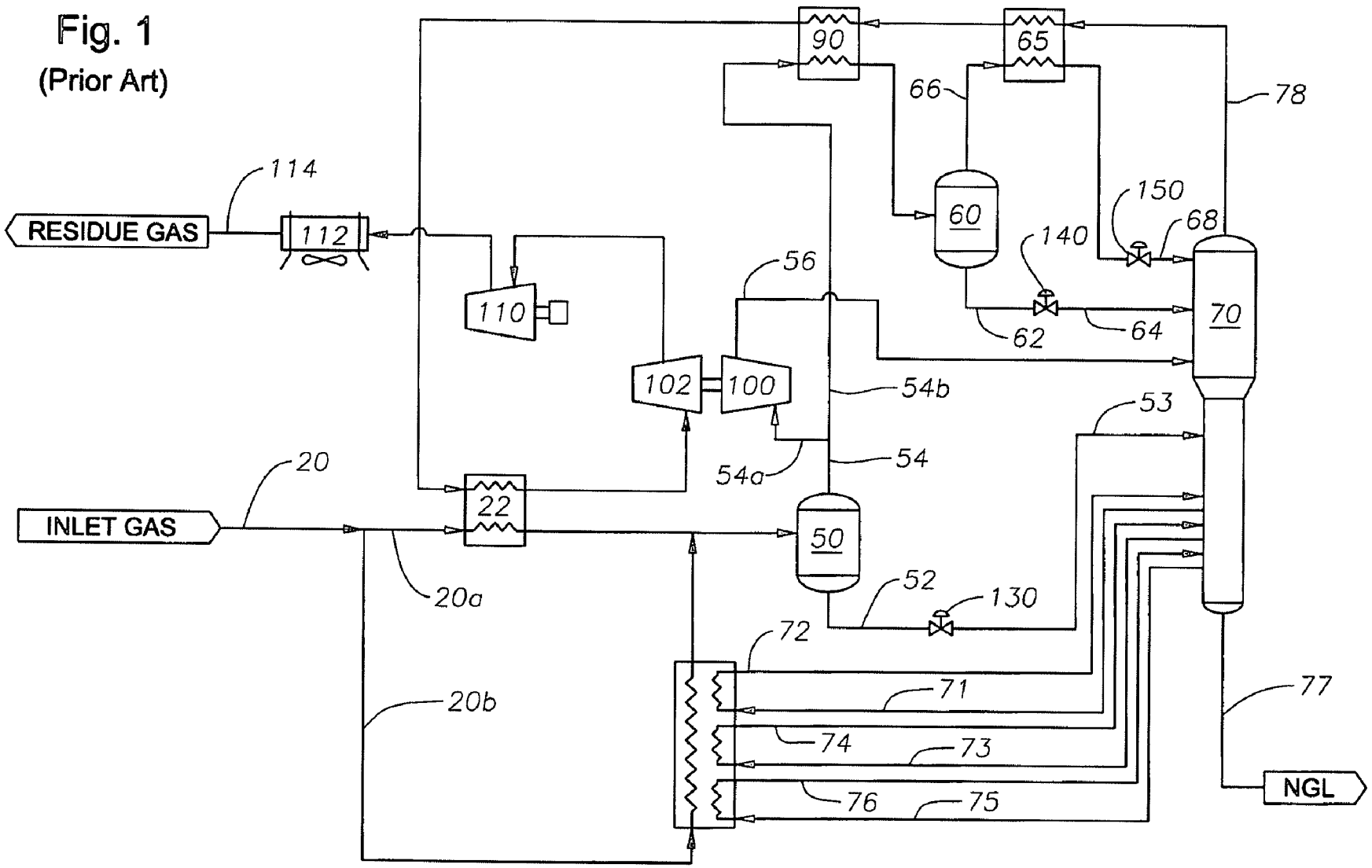
Fig. 1 (Prior Art)
FIG. 1 is a simplified flow diagram of a typical C2+ compound recovery process, in accordance with a prior art process in U.S. Pat. No. 4,519,824 issued to Huebel.
Figure 2:
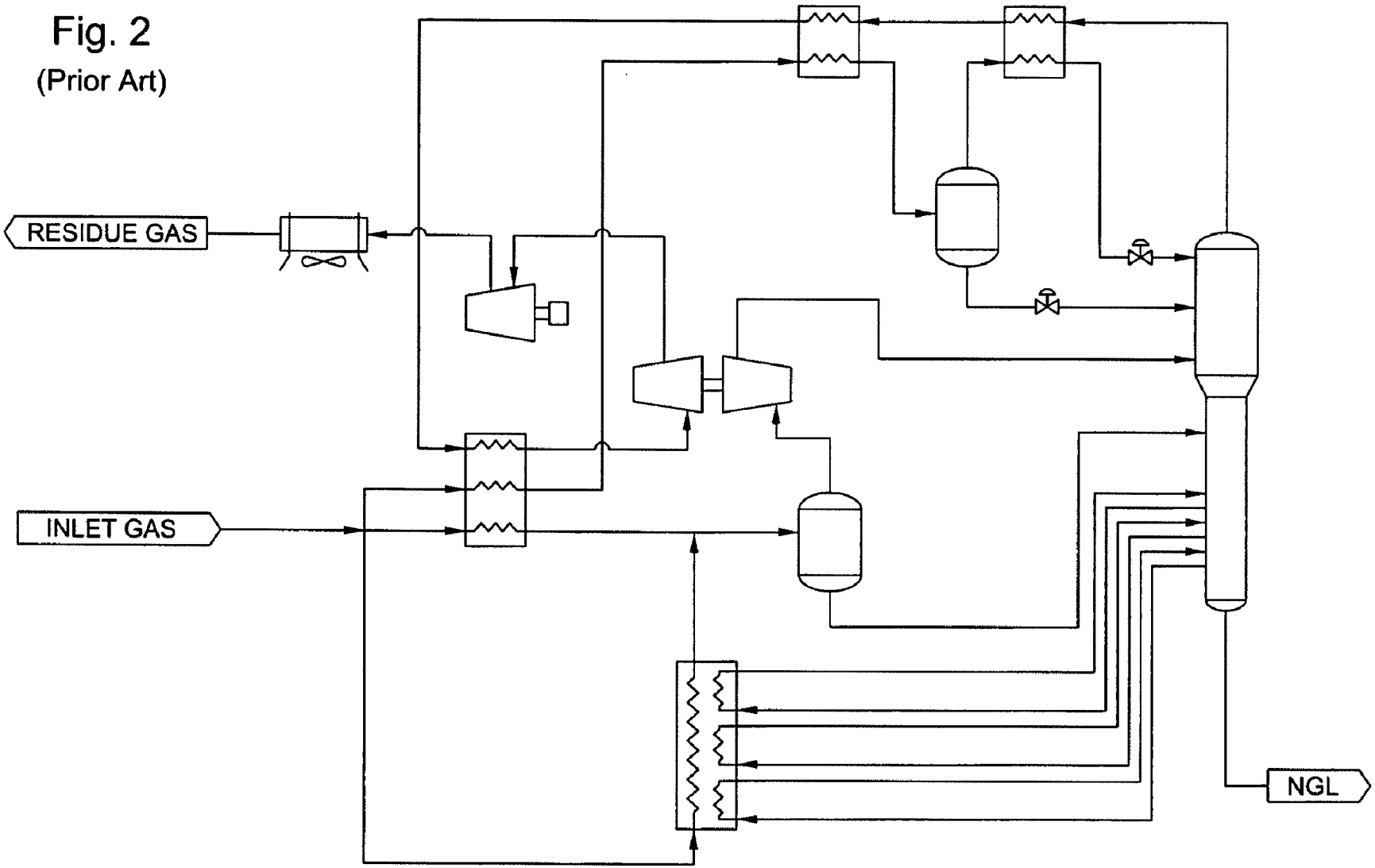
Fig. 2 (Prior Art)
FIG. 2 is a simplified flow diagram of a second typical C2+ compound recovery process, in accordance with prior art processes.

FIG. 1 illustrates a prior art process as illustrated in U.S. Pat. No. 4,519,824 issued to Huebel. Raw feed gas to the plant can contain certain impurities that are detrimental to cryogenic processing, such as water, $CO_2$, $H_2S$, and the like. It is assumed that raw feed gas stream is treated to remove $CO_2$ and $H_2S$, if present in large quantities (not shown). This gas is then dried and filtered before being sent to the cryogenic section of the plant. Inlet feed gas stream 20 is split into a first feed stream 20*a* and a second feed stream 20*b*. First feed stream 20*a*, which is 58% of the feed gas stream flow, is cooled against cold streams in the inlet gas exchanger 22 to −37° F. Second feed stream 20*b* is cooled against cold streams from the distillation tower to −22° F. The two cold feed streams 20*a*, 20*b* are then mixed and sent to the cold separator 50 for phase separation. Cold separator 50 runs at −31° F. Depending on the composition and feed pressure of the feed gas stream 20, some external cooling, preferably in the form of propane refrigeration, could be required to assist in cooling first and second feed streams 20*a*, 20*b*. In this example, the pressures and temperatures were selected so that a propane refrigerant at −18° F. was required to provide sufficient cooling. Cold separator 50 produces a separator bottoms stream 52 and a separator overhead stream 54. Separator bottoms stream 52 is expanded through first expansion valve 130 to 257 psia, thereby cooling it to −70° F. This cooled and expanded separator bottoms stream is sent to a demethanizer 70 as a bottom tower feed stream 53.

Separator overhead stream 54 is split into a first separator overhead stream 54*a*, which contains 66% of the flow, and a second separator overhead stream 54*b*, which contains the remainder of the flow. Consequently, first separator overhead stream 54*a* is isentropically expanded in expander 100 to 252 psia. Due to reduction in pressure and extraction of work from the stream, the resulting expanded stream 56 cools to −115° F., and is sent to demethanizer 70 as a lower middle tower feed stream 56.

Second separator overhead stream 54*b* is cooled to −85° F. and partially condensed in subcooler exchanger 90 by heat exchange with cold streams and supplied to reflux separator 60. Reflux separator 60 produces a reflux separator bottoms stream 62 that is expanded across valve 140 to 252 psia thereby cooling the stream to −150° F. This expanded stream is then sent to the demethanizer tower as third, or upper middle, tower feed stream 64. Reflux separator 60 also produces a reflux separator overhead stream 66. This vapor stream 66 is cooled to −156° F. in reflux exchanger 65 whereby it is fully condensed. This cooled stream 66 is then expanded across valve 150 to 252 psia whereby it is cooled to −166 F. This cold stream 68 is then sent to demethanizer 70 as a fourth tower feed stream 68.

The demethanizer tower 70 is a reboiled absorber that produces a tower bottoms stream, or C2+ product stream, 77 and a tower overhead stream, or lean residue stream, 78. The tower is provided with side reboilers that cool at least a portion of the inlet gas stream and make the process more efficient by providing cooling streams at lower temperatures. The lean residue gas stream 78 leaving the tower overhead at −164° F. is heated in reflux exchanger 65 to −106° F., then further heated to −53° F. in the subcooler 90, and then even further heated to 85° F. in inlet gas exchanger 22. This warmed low pressure gas is boosted in booster compressor 102, which operates off power generated by expander 100. Gas leaving the booster compressor 102 at 298 psia is then compressed in residue compressors 110 to 805 psia. Hoot residue gas is cooled in air cooler 112 and sent as product residue gas stream 114 for further processing. Results for the simulation are shown in Table 1.

TABLE I

PRIOR ART EXAMPLE

| Component | Feed Stream 20 Mol % | C2+ Product Stream 77 Mol % | Residue Gas Stream 114 Mol % |
|---|---|---|---|
| Nitrogen | 0.186 | 0.000 | .0216 |
| $CO_2$ | 0.381 | 1.235 | 0.245 |
| Methane | 85.668 | 0.529 | 99.167 |
| Ethane | 7.559 | 52.904 | 0.369 |
| Propane | 3.324 | 24.276 | 0.003 |
| i-Butane | 0.480 | 3.509 | 0.000 |
| n-Butane | 0.984 | 7.192 | 0.000 |
| i-Pentane | 0.274 | 2.004 | 0.000 |
| n-Pentane | 0.294 | 2.148 | 0.000 |
| C6+ | 0.849 | 6.202 | 0.000 |
| Temperature, ° F. | 90 | 80 | 120 |
| Pressure, psia | 800 | 545 | 875 |
| Mol Wt | 19.695 | 41.802 | 16.190 |
| Mol/hr | 96685.7 | 13232.1 | 83453.6 |
| MMSCFD | 880.57 | | 760.06 |
| BPD | | 81941.3 | |
| % C2 Recovery | 95.79 | | |
| % C3 Recovery | 99.93 | | |
| Residue Compression, hp | 53684 | | |
| Refrig hp | 3036 | | |
| Total hp | 56720 | | |

FIRST PRESENT INVENTION EXAMPLE

Figure 7:
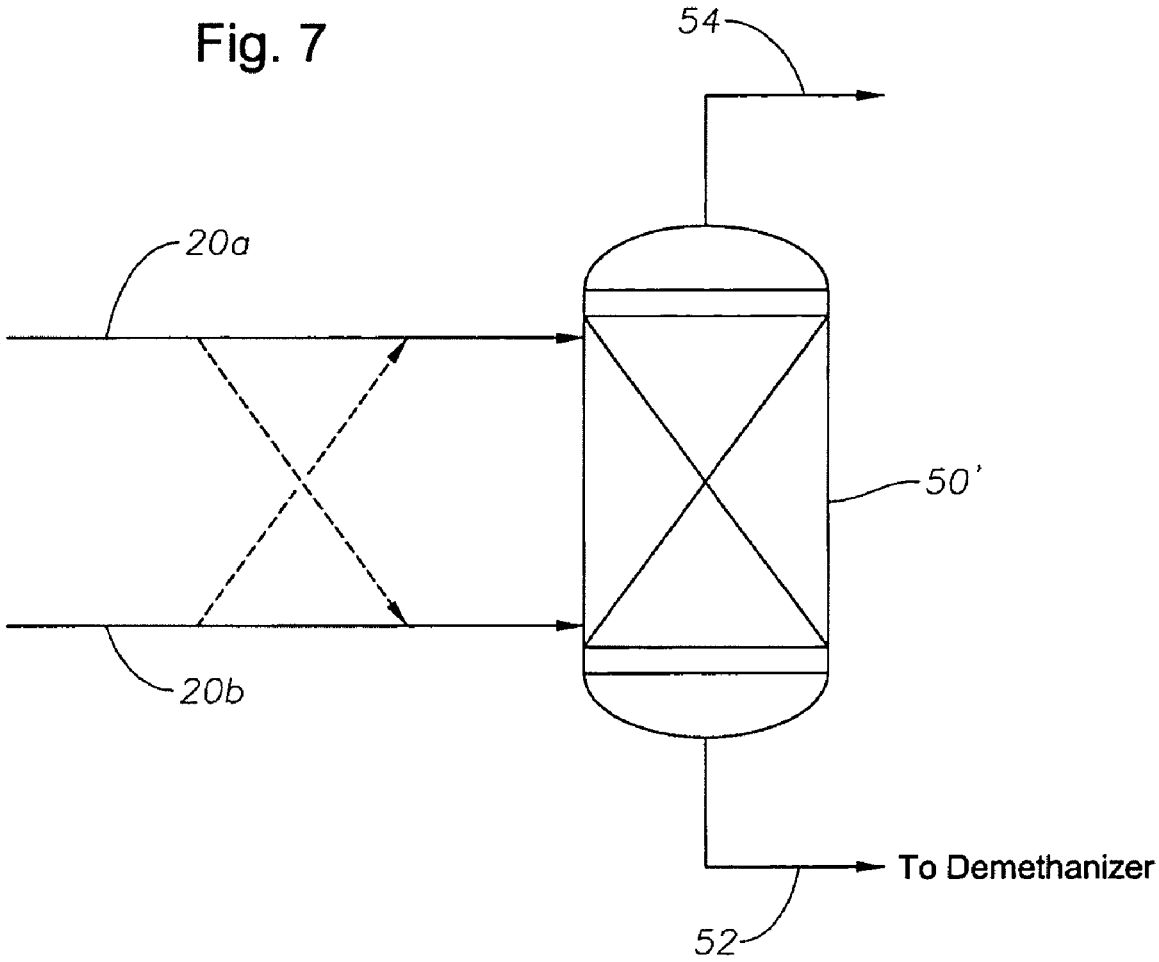
FIG. 7 is a simplified diagram illustrating an optional feed configuration for inlet streams sent to the cold absorber according to an embodiment of the present invention.

One element of the present invention is detailed in FIG. 7. This element includes splitting the hydrocarbon feed stream into two streams, a first inlet stream 20*a* and a second inlet stream 20*b*, and supplying each of these streams to a cold separator 50. First inlet stream 20*a*, which has a temperature colder than second inlet stream 20*b*, is supplied to a top of the cold separator 50 and second inlet stream 20*b* is supplied at a bottom of cold absorber 50. This feature can be used because the two inlet gas streams 20*a* and 20*b*, which are respectively −37° F. and −22° F., exit their respective exchangers at different temperatures. The colder of the two streams is sent to the top of a packed bed, or mass transfer zone, in the cold separator 50, and the warmer of the two streams is introduced at the bottom of the bed or zone. This introduces a driving force due to the difference in latent heat in the two streams. In this embodiment, cold separator 50 is preferably a cold absorber 50'. An embodiment of the present invention utilizing the enhanced feed arrangement shown in FIG. 7 has been simulated. The same residue and refrigeration compression requirements that were used in the Prior Art Example were used in this example to highlight the improved performance associated with the present invention. The results of this simulation are provided in Table 1a.

TABLE 1a

COMPARING FIRST PRIOR ART EXAMPLE WITH FIRST PRESENT INVENTION EXAMPLE

| | Stream 54 | | Stream 52 | |
|---|---|---|---|---|
| Component | FIG. 1 - mol/hr | FIG. 7 - NEW mol/hr | FIG. 1 - mol/hr | FIG. 7 - NEW mol/hr |
| Nitrogen | 176.534 | 177.027 | 3.5695 | 3.103 |
| $CO_2$ | 318.054 | 324.409 | 50.211 | 43.856 |
| Methane | 77946.088 | 78599.541 | 4882.506 | 4229.052 |
| Ethane | 5472.445 | 5634.378 | 1835.813 | 1673.880 |
| Propane | 1510.192 | 1535.912 | 1704.120 | 1678.401 |
| i-Butane | 128.848 | 126.868 | 335.486 | 337.466 |
| n-Butane | 201.878 | 196.433 | 749.807 | 755.252 |
| i-Pentane | 28.199 | 26.914 | 236.992 | 238.277 |
| n-Pentane | 22.745 | 21.622 | 261.460 | 262.583 |
| C6+ | 23.619 | 22.306 | 797.072 | 798.384 |
| Temperature, ° F. | −31 | −32.01 | −31 | −22.39 |
| Pressure, psia | 795 | 795 | 795 | 795 |
| Mol Wt | 17.774 | 17.788 | 34.883 | 36.193 |
| Mol/hr | 85828.6 | 86665.4 | 10857.1 | 10020.3 |
| MMSCFD | 781.7 | 789.3 | | |
| BPD | | | 57408.3 | 53977.5 |
| % C2 Recovery | 95.79 | 96.13 | | |
| Residue hp | 53684 | 53648 | | |
| Refrigeration hp | 3036 | 2962 | | |

As can be seen in Table 1a, providing the warmer stream 20*b* at the bottom of the packed bed provides stripping vapors that strip components from the liquid descending down the bed. This step enriches the lighter components in separator overhead gas stream 54, and heavier components in separator bottoms stream 52. The 0.34% increase in ethane recovery is due to the enriched vapor separator overhead gas stream 54. A more pronounced effect can be observed if the temperature difference between streams 20*a* and 20*b* is larger.

SECOND PRESENT INVENTION EXAMPLE

Figure 5:
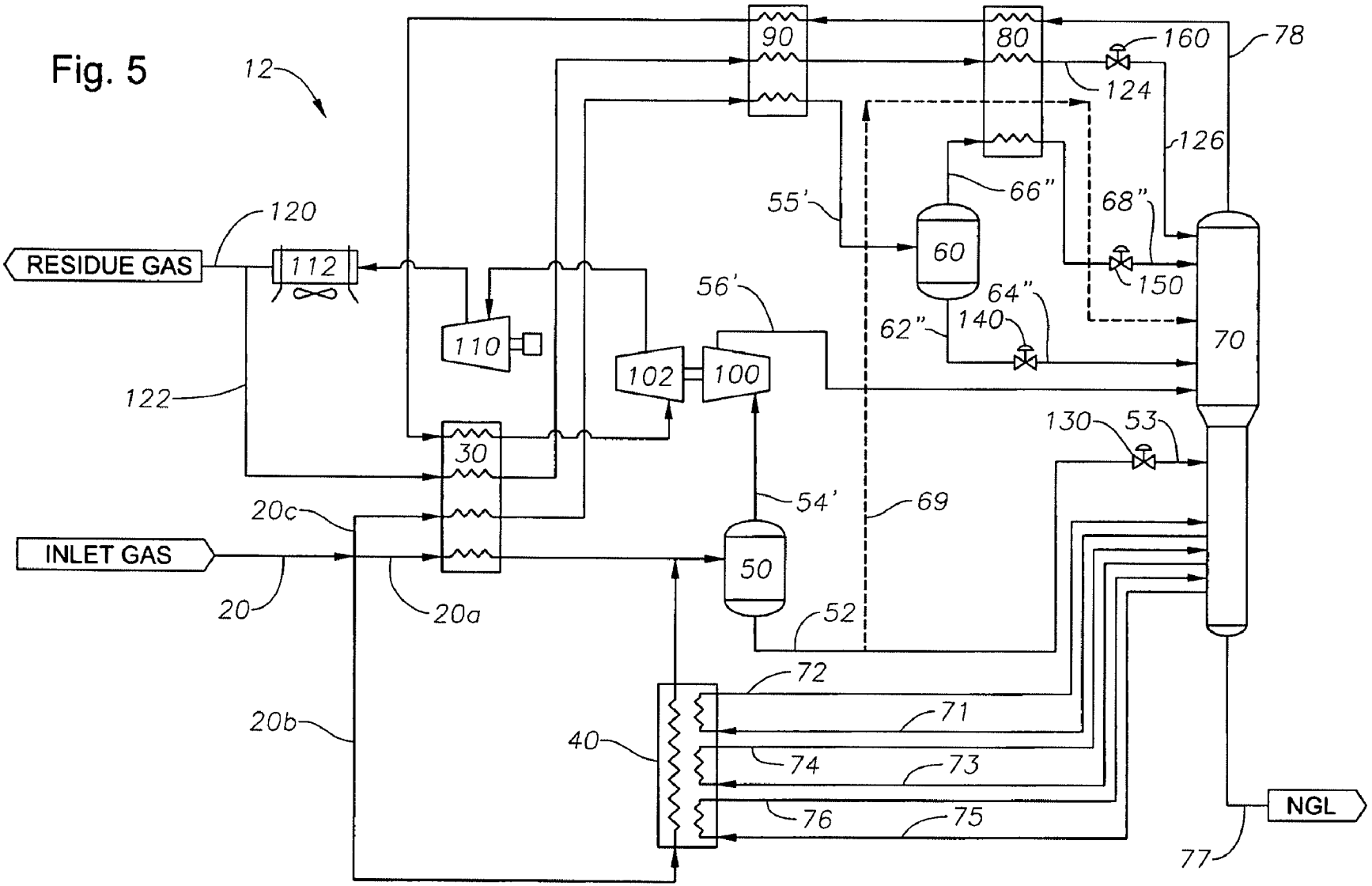
FIG. 5 is a simplified flow diagram of a C2+ compound recovery process that incorporates the improvements of the present invention into the recovery process of FIG. 2 and is configured to decrease the compression requirements through the use of a residue gas reflux stream as a reflux stream to the demethanizer in accordance with another alternate embodiment of the present invention.

FIG. 5 illustrates one embodiment of the present invention, which includes an improved C2+ compound recovery scheme 10. As mentioned in connection with the prior art example, raw feed gas to the plant can contain certain impurities, such as water, $CO_2$, $H_2S$, and the like, that are detrimental to cryogenic processing. It is assumed that raw feed gas stream is treated to remove $CO_2$ and $H_2S$, if present in large quantities. This gas is then dried and filtered before being sent to the cryogenic section of the plant. In this example, inlet feed gas stream 20 is split into first inlet stream 20*a*, which contains 36% of inlet feed gas stream flow, and second inlet stream 20*b*, which contains 52% of the inlet feed gas stream flow, and stream 20*c* containing the remainder of the inlet feed gas stream flow. First inlet stream 20*a* is cooled in inlet exchanger 30 by heat exchange contact with cold streams to −58° F. Second inlet stream 20*b* is cooled in demethanizer reboiler 40 by heat exchange contact with a first reboiler streams 71, 73, 75 to −58° F. In all embodiments of this invention, inlet exchanger 30 and demethanizer reboiler 40 can be a single multi-path exchanger, a plurality of individual heat exchangers, or combinations and variations thereof. Next, inlet streams 20*a*, 20*b* are combined and sent to a cold separator 50, which operates at −58° F. Depending on the composition and feed pressure of inlet feed gas stream 20, some external cooling in the form of propane refrigeration could be required to sufficiently cool the inlet gas streams 20*a*, 20*b*. The pressures and temperatures were selected for this example to require a propane refrigerant at −33° F. As shown in FIG. 7, if a cold absorber 50' is used as discussed herein, the colder of two inlet streams 20*a*, 20*b* can be sent to the top of cold absorber 50', with the warmer of two inlet streams 20*a*, 20*b* being sent to the bottom of cold absorber 50'. FIG. 7 illustrates a bypass option to allow for directing of 20*a* and 20*b* to cold absorber 50' top or bottom depending upon temperature. Cold absorber 50' preferably includes at least one mass transfer zone. In this example, the mass transfer zone can be a tray or similar equilibrium separation stage or a flash vessel.

Cold separator 50 produces a separator bottoms stream 52 and separator overhead stream 54'. Separator bottoms stream 52 is expanded through a first expansion valve 130 to 475 psia thereby cooling it to −84° F. This cooled and expanded stream is sent to demethanizer 70 as a first demethanizer, or tower, feed stream 53.

Separator overhead stream 54' is essentially isentropically expanded in expander 100 to 465 psia. Due to reduction in pressure and extraction of work from the stream, the resulting expanded stream 56' is cooled to −101° F. and sent to demethanizer 70, preferably, below a third tower feed stream 64" as a second feed tower stream 56'. This work is later recovered in a booster compressor 102 driven by expander 100 to partially boost pressure of a demethanizer overhead stream 78.

Third inlet vapor stream 20*c* is cooled in inlet gas exchanger 30 to −55° F. and partially condensed. This stream is then further cooled in subcooler exchanger 90 to −70° F. by heat exchange contact with cold streams and supplied to reflux separator 60 as intermediate reflux stream 55'. Reflux separator 60 produces reflux separator bottoms stream 62" and reflux separator overhead stream 66" Reflux separator bottoms stream 62" is expanded by a second expansion valve 140 and supplied to demethanizer 70, preferably, below fourth tower feed stream 68" as third tower feed stream 64" In addition, reflux separator overhead stream 66" is cooled in reflux condenser 80 by heat exchange contact with cold streams, expanded by a third expansion valve 150 to 465 psia thereby cooling the stream to −133° F., and supplying it to demethanizer tower 70 as fourth tower feed stream 68" below demethanizer reflux stream 126.

Demethanizer 70 is also supplied second tower feed stream 56', third tower feed stream 64" fourth tower feed stream 68" and demethanizer reflux stream 126, thereby producing demethanizer overhead stream 78, demethanizer bottoms stream 77, and three reboiler side streams 71, 73, and 75.

In demethanizer 70, rising vapors in first tower feed stream 53 are at least partially condensed by intimate contact with falling liquids from second tower feed stream 56, third tower feed stream 64, fourth tower feed stream 68, and demethanizer reflux stream 126, thereby producing demethanizer overhead stream 78 that contains a substantial amount of the methane and lighter components from inlet feed gas stream 20. Condensed liquids descend down demethanizer 70 and are removed as demethanizer bottoms stream 77, which contains a major portion of ethane, ethylene, propane, propylene and heavier components from inlet feed gas stream 20.

Reboiler streams 71, 73, and 75 are preferably removed from demethanizer 70 in the lower half of vessel. Further, three reboiler streams 71, 73, and 75 are warmed in demethanizer reboiler 40 and returned to demethanizer as reboiler reflux streams 72, 74, and 76, respectively. The side reboiler design allows for the recovery of refrigeration from demethanizer 70.

Demethanizer overhead stream 78 is warmed in reflux condenser 80, reflux subcooler exchanger 90, and front end exchanger 30 to 90° F. After warming, demethanizer overhead stream 78 is compressed in booster compressor 102 to 493 psia by power generated by the expander. Intermediate pressure residue gas is then sent to residue compressor 110 where the pressure is raised above 800 psia or pipeline specifications to form residue gas stream 120. Next, to relieve heat generated during compression, compressor aftercooler 112 cools residue gas stream 120. Residue gas stream 120 is a pipeline sales gas that contains a substantial amount of the methane and lighter components from inlet feed gas stream 20, and a minor portion of the C2+ components and heavier components.

At least a portion of residue gas stream 120 is returned to the process to produce a residue gas reflux stream 122 at a flowrate of 291.44 MMSCFD. First, this residue gas reflux stream 122 is cooled in front end exchanger 30, reflux subcooler exchanger 90, and reflux condenser 80 to −131° F. by heat exchange contact with cold streams to substantially condense the stream. Next, this cooled residue gas reflux stream 124 is expanded through a fourth expansion valve 160 to 465 psia whereby it is cooled to −138° F., and sent to demethanizer 70 as a demethanizer reflux stream 126. Preferably, demethanizer reflux stream 126 is sent to demethanizer 70 above fourth tower feed stream 68" as top feed stream to demethanizer 70. As indicated previously, the external propane refrigeration system is a two stage system, as understood by those of ordinary skill in the art, that was used for simulating both processes. Any other cooling medium can be used instead of propane, and is to be considered within the scope of the present invention. The results of the simulation based upon the process shown in FIG. 5 are provided in Table 2.

TABLE 2

SECOND PRESENT INVENTION EXAMPLE

| Component | Feed Stream 20 Mol % | C2+ Product Stream 77 Mol % | Residue Gas Stream 120 Mol % |
|---|---|---|---|
| Nitrogen | 0.186 | 0.000 | 0.216 |
| $CO_2$ | 0.381 | 1.191 | 0.252 |
| Methane | 85.668 | 0.833 | 99.184 |
| Ethane | 7.559 | 52.820 | 0.348 |
| Propane | 3.324 | 24.189 | 0.000 |

TABLE 2-continued

| SECOND PRESENT INVENTION EXAMPLE | | | |
|---|---|---|---|
| Component | Feed Stream 20 Mol % | C2+ Product Stream 77 Mol % | Residue Gas Stream 120 Mol % |
| i-Butane | 0.480 | 3.494 | 0.000 |
| n-Butane | 0.984 | 7.162 | 0.000 |
| i-Pentane | 0.274 | 1.996 | 0.000 |
| n-Pentane | 0.294 | 2.139 | 0.000 |
| C6+ | 0.849 | 6.176 | 0.000 |
| Temperature, ° F. | 90 | 108.6 | 120 |
| Pressure, psia | 800 | 550 | 875 |
| Mol Wt | 19.695 | 41.707 | 16.188 |
| Mol/hr | 96685.7 | 13288.1 | 83397.6 |
| MMSCFD | 880.57 | | 759.55 |
| BPD | | 82190.6 | |
| % C2 Recovery | 96.04 | | |
| % C3 Recovery | 100 | | |
| Residue Compression, hp | 36913 | | |
| Refrig hp | 12853 | | |
| Total hp | 49766 | | |

When comparing Tables 1 and 2, it can be seen that the new process illustrated in FIG. 5 requires about 14% lower total compression power, while recovering 0.25% more ethane and essentially the same amount of propane, than the process shown in FIG. 1. This lower compression power will result in substantial savings in capital and operating costs.

An additional advantage or feature of the present invention is its ability to resist $CO_2$ freezing. Since the demethanizer tower has a tendency to build up $CO_2$ on the trays, the location that first experiences $CO_2$ freeze calculation is the top section of the demethanizer tower. In the prior art process shown in FIG. 1 and demonstrated in the Prior Art Example, tray 2 has 2.57 mol % $CO_2$ and operates at −157.5° F. These are the conditions when $CO_2$ starts to freeze, which sets the lowest pressure at which the demethanizer can operate. $CO_2$ freeze is based on Gas Processors Association (GPA) Research Report RR-10 data. For the present invention as illustrated in FIG. 5 and demonstrated in the Second Present Invention Example, the demethanizer is run at a considerably higher pressure. For the same amount of $CO_2$ in the feed gas stream, tray three in the demethanizer is the coldest, but is still well above the $CO_2$ freeze point. Tray 3 runs at −129.5° F. and has 1.28 mol % $CO_2$. These conditions give an approach to $CO_2$ freeze of 50° F. The present invention process is able to tolerate substantially more $CO_2$ in the feed gas stream without $CO_2$ freezing in the demethanizer, which is a considerable improvement over prior art processes, such as the one illustrated in FIG. 1. Simulation runs indicate that $CO_2$ in the feed gas stream of the process of the current invention can be increased up to 5.5 times greater than in prior art processes before freezing occurs in the demethanizer. Therefore, by using the process according to an embodiment of the present invention, one embodiment includes avoiding $CO_2$ removal from the feed gas, which is called an untreated feed stream. The economic advantages of such embodiment using an untreated feed stream are substantial.

Using dual reflux streams for the present invention process embodiments has several advantages. The lower reflux, which is part of the feed gas stream or cold separator overhead stream, is richer in ethane and cannot produce ethane recoveries beyond the low to mid 90's. The top reflux, which is essentially residue gas, is lean in ethane and can be used to achieve high ethane recoveries in the mid to high 90's range. However, processes utilizing residue recycle streams can be expensive to operate because residue gas streams need to be compressed up to pressures where the streams can condense. Hence the size of this stream needs to be kept to a minimum. Optimizing the process by using a combination of these refluxes makes the process most efficient. During the life of a project there can be times when there is a need to process more gas through the plant at the expense of some ethane recovery. The process according to the present invention is advantageously flexible to allow for changes in the recovery requirements. For example, the top lean reflux stream can be reduced, thereby reducing the load on the residue compressors, which will in turn allow the plant to process more gas throughput. There can also be times during the life of the project where ethane needs to be rejected, while still maintaining high propane recovery. Manipulation of the dual reflux streams allows operating scheme adjustments to meet specific goals. The intermediate reflux stream can be reduced to lower ethane recovery, while the top reflux stream can be maintained to minimize propane loss.

As shown in FIG. 5, a portion of cold separator bottoms stream can be subcooled and then sent to demethanizer 70 towards the top of demethanizer 70 as tower feed stream 69. The cold liquid in tower feed stream 69 acts as a lean oil absorbing the C2+ components, thereby increasing recovery. A simulation for FIG. 5 was performed subcooling a portion of cold separator bottoms stream and adding it towards the top of demethanizer tower 70. Results of this simulation are shown in Table 3. For a lower total compression, there was a 0.2% increase in ethane recovery.

TABLE 3

| PRESENT INVENTION - (FIG. 5) | | | |
|---|---|---|---|
| Component | Feed Stream 20 Mol % | C2+ Product Stream 77 Mol % | Residue Gas Stream 120 Mol % |
| Nitrogen | 0.186 | 0.000 | 0.216 |
| $CO_2$ | 0.381 | 1.464 | 0.207 |
| Methane | 85.668 | 0.832 | 99.244 |
| Ethane | 7.559 | 52.715 | 0.332 |
| Propane | 3.324 | 24.099 | 0.000 |
| i-Butane | 0.480 | 3.482 | 0.000 |
| n-Butane | 0.984 | 7.136 | 0.000 |
| i-Pentane | 0.274 | 1.988 | 0.000 |
| n-Pentane | 0.294 | 2.131 | 0.000 |
| C6+ | 0.849 | 6.154 | 0.000 |
| Temperature, ° F. | 90 | 107.7 | 120 |
| Pressure, psia | 800 | 550 | 875 |
| Mol Wt | 19.695 | 41.702 | 16.173 |
| Mol/hr | 96685.7 | 13336.9 | 83348.8 |
| MMSCFD | 880.57 | | 759.10 |
| BPD | | 82393.7 | |
| % C2 Recovery | 96.2 | | |
| % C3 Recovery | 99.99 | | |
| Residue Compression, hp | 36556 | | |
| Refrig hp | 12984 | | |
| Total hp | 49540 | | |

Figure 3:
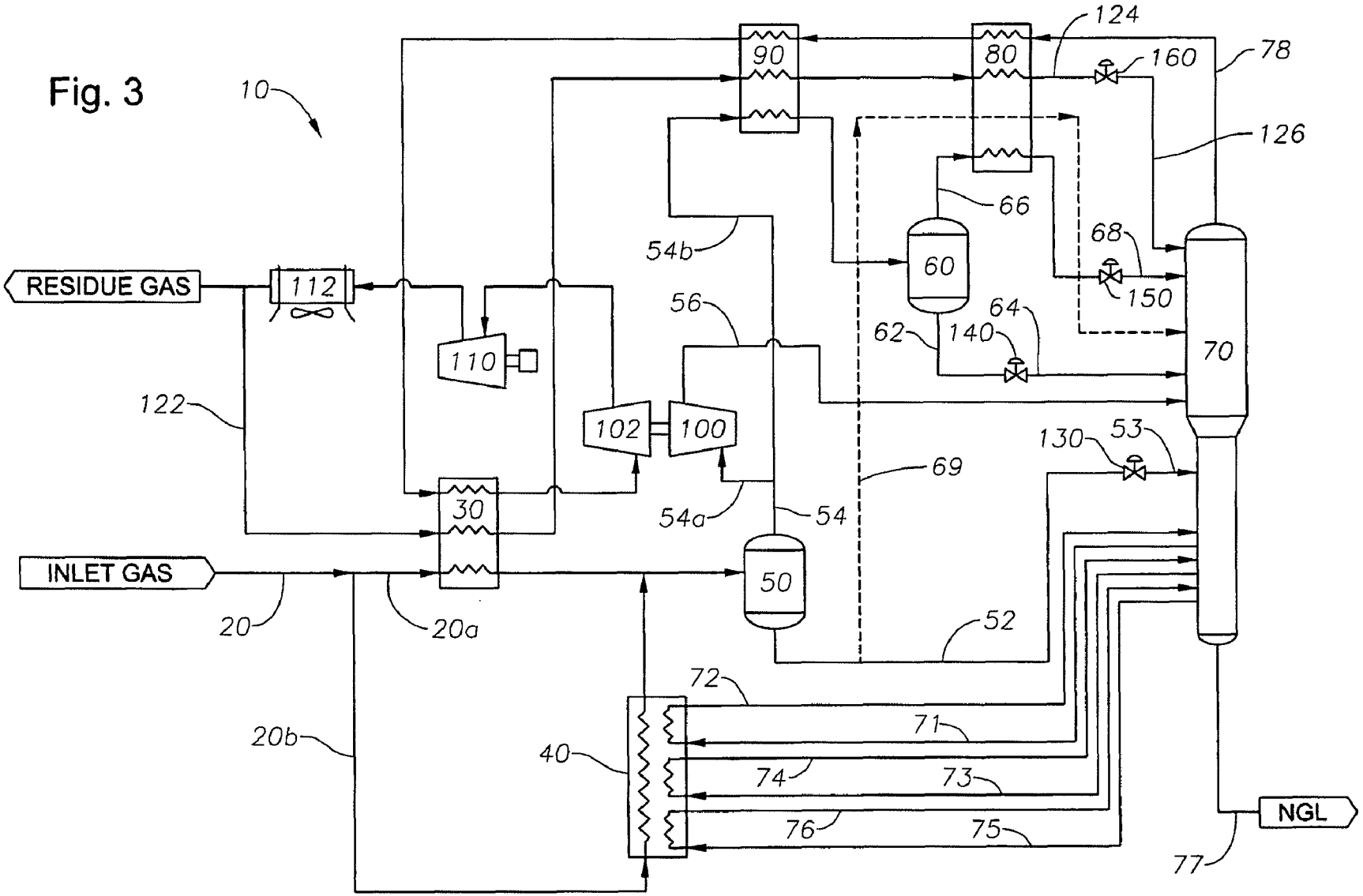
FIG. 3 is a simplified flow diagram of a C2+ compound recovery process that incorporates the improvements of the present invention into the recovery process of FIG. 1 and is configured to decrease compression requirements through use of a residue gas reflux stream as a fourth tower feed stream to the demethanizer in accordance with one embodiment of the present invention.

FIG. 3 illustrates an alternate embodiment of an improved C2+ recovery process 10 according to the present invention. This scheme differs from FIG. 5 because of the source of the intermediate reflux stream 55'. Instead of deriving the intermediate reflux stream 55' from inlet feed stream 20*c* as in FIG. 5, intermediate reflux stream 54*b* is used, which is a portion of cold separator overhead stream 54. The remaining steps of the processes are identical.

Figure 4:
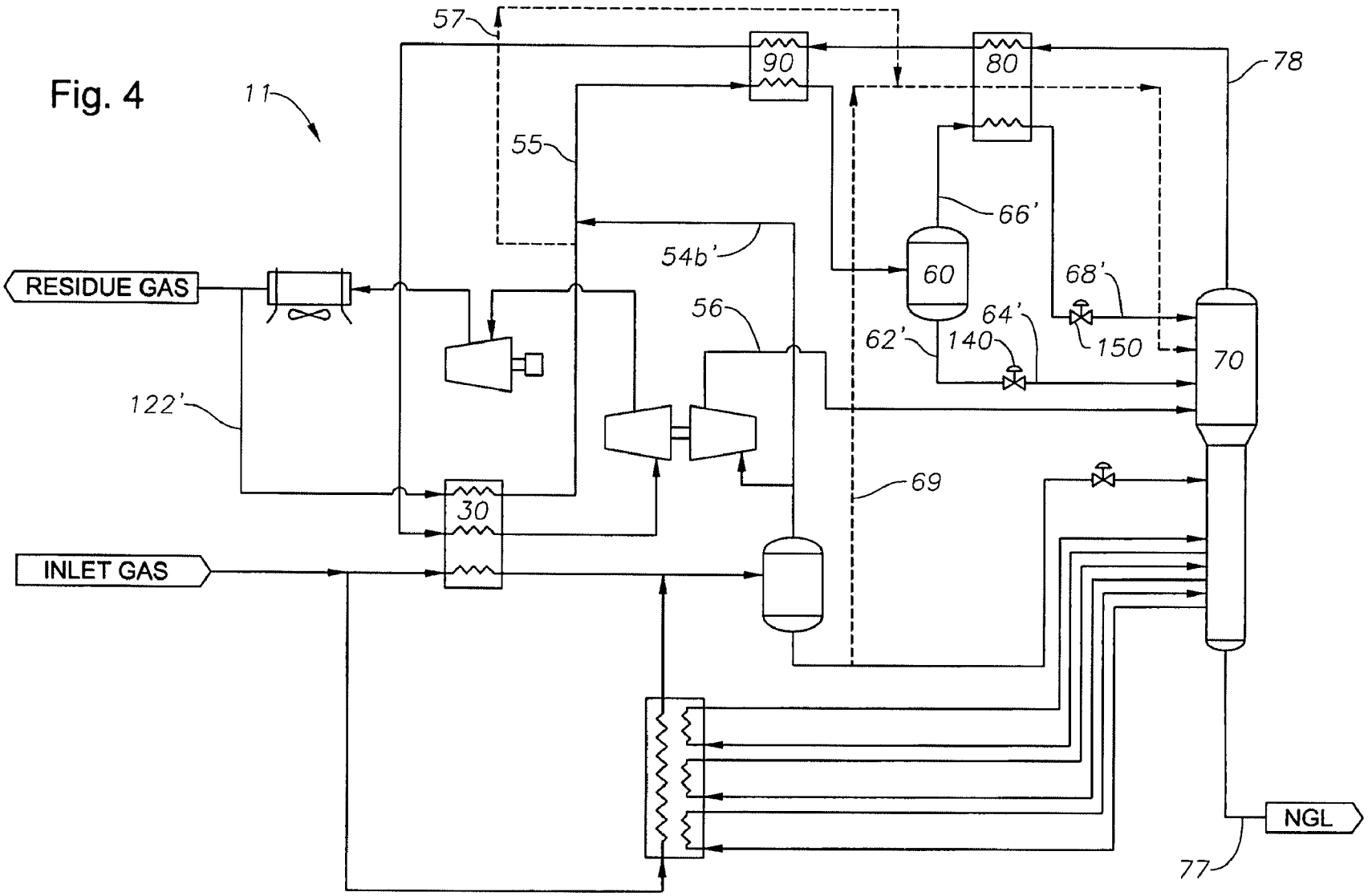
FIG. 4 is a simplified flow diagram of a C2+ compound recovery process that incorporates the improvements of the present invention into recovery process of FIG. 1 and is configured to decrease the compression requirements through the combination of a residue gas reflux stream with the second separator overhead stream in accordance with an alternate embodiment of the present invention.

FIG. 4 depicts an alternate embodiment of an improved C2+ recovery process 11, wherein residue gas reflux stream 122' is cooled in front end exchanger 30 by heat exchange contact with cold streams and then combined with second separator overhead stream 54*b*' to produce a combined reflux stream 55. This combined reflux stream 55 is then cooled in recycle subcooler 90 by heat exchange contact with cold streams. Next, combined recycle stream 55 is supplied to reflux separator 60, wherein reflux separator 60 produces a reflux separator bottoms stream 62' and a reflux separator overhead stream 66'.

Figure 6:
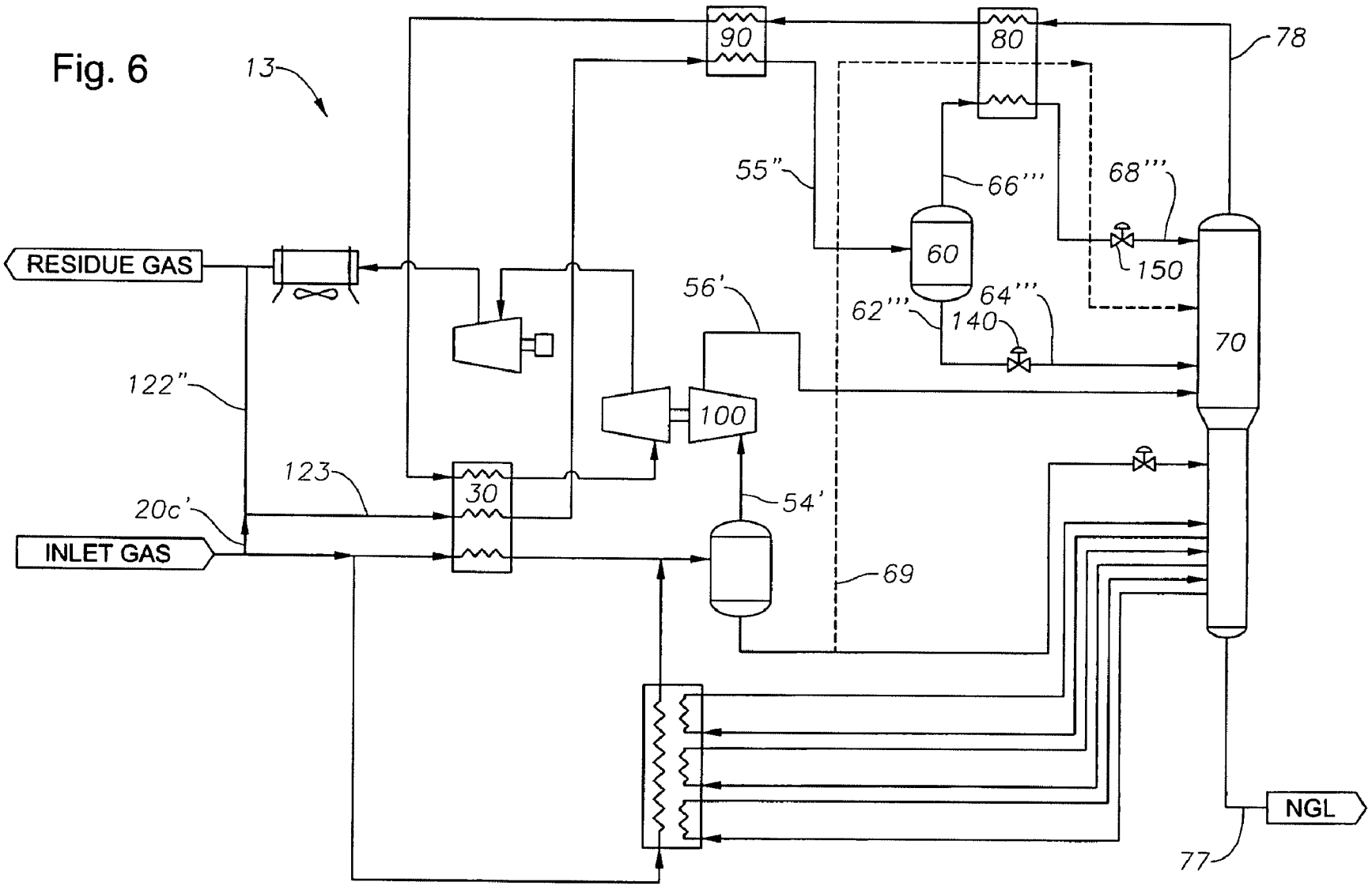
FIG. 6 is a simplified flow diagram of a C2+ compound recovery process that incorporates the improvements of the present invention into the recovery process of FIG. 2 and is configured to decrease the compression requirements through the combination of a residue gas reflux stream with the third inlet stream in accordance with yet another embodiment of the present invention.

Tower feed stream 69 can be utilized in the processes illustrated in FIGS. 3, 4, and 6, as described in reference to the process illustrated in FIG. 5. In FIG. 4, a portion of combined reflux stream 55 as combined reflux side stream 57 can be combined with tower feed stream 69, prior to sending the stream to demethanizer 70.

As shown in FIG. 4, reflux separator bottoms stream 62' is expanded through second expansion valve 140 and then sent to demethanizer 70, preferably below fourth tower feed stream 68', as a third tower feed stream 64'. Reflux separator overhead stream 66' is cooled in a reflux condenser 80 by heat exchange contact with at least demethanizer overhead stream 78, expanded through third expansion valve 150, and then supplied to demethanizer 70 as fourth tower feed stream 68'. Fourth tower feed stream 68' is preferably highest feed stream sent to demethanizer 70.

In yet another embodiment of the present invention, FIG. 6 depicts another improved C2+ recovery process 13, wherein residue gas reflux stream 122" is combined with third inlet stream 20*c*' to produce a combined inlet/recycle stream 123. This combined inlet/reflux stream 123 is cooled in front end exchanger 30 and reflux subcooler 90 through heat exchange contact with demethanizer overhead stream 78. Further, cooled inlet/recycle stream 55" is next sent to reflux separator 60. Consequently, reflux separator 60 produces a reflux separator bottoms stream 62''' reflux separator overhead stream 66''' Reflux separator bottoms stream 62''' is expanded through second expansion valve 140 and then sent to demethanizer 70, preferably below fourth tower feed stream 68''' as third tower feed stream 64''' Reflux separator overhead stream 66''' is cooled in reflux condenser 80 by heat exchange contact with demethanizer overhead stream 78, expanded through third expansion valve 150, and then supplied to demethanizer 70 as a demethanizer reflux stream, or fourth tower feed stream 68'''. Fourth tower feed stream 68''' is preferably the highest feed stream sent to demethanizer 70.

In the embodiment shown in FIG. 6, separator overhead stream 54' is not split into two streams, but is maintained as a single stream. Instead, separator overhead stream is expanded in expander 100 and sent to demethanizer 70, preferably below third tower feed stream 64''', as second tower feed stream 56'.

In addition to the process embodiments, apparatus embodiments for the apparatus used to perform the processes described herein are also advantageously provided. As another embodiment of the present invention, an apparatus for separating a gas stream containing methane and ethane, ethylene, propane, propylene, and heavier components into a volatile gas fraction containing a substantial amount of the methane and lighter components and a less volatile fraction containing a large portion of ethane, ethylene, propane, propylene, and heavier components is advantageously provided. The apparatus preferably includes a first exchanger 30, a cold separator 50, a demethanizer 70, an expander 100, a second cooler 90, a reflux separator 60, a third cooler 80, a first heater 80, and a booster compressor 102.

First, or inlet, exchanger 30 is preferably used for cooling and at least partially condensing a hydrocarbon feed stream. Cold separator 50 is used for separating the hydrocarbon feed stream into a first vapor stream, or cold separator overhead stream, 54 and a first liquid stream, or cold separator bottoms stream, 52.

Demethanizer 70 is used for receiving the first liquid stream 52 as a first tower feed stream, an expanded first separator overhead stream 56 as a second tower feed stream, a reflux separator bottoms stream 62 as a third tower feed stream, and a reflux separator overhead stream 66 as a fourth tower feed stream. Demethanizer 70 produces a demethanizer overhead stream 78 containing a substantial amount of the methane and lighter components and a demethanizer bottoms stream 77 containing a major portion of recovered ethane, ethylene, propane, propylene, and heavier components.

Expander 100 is used to expand first separator overhead stream 54 to produce the expanded first separator overhead stream 56 for supplying to demethanizer 70. Second cooler, or reflux subcooler exchanger, 90 can be used for cooling and at least partially condensing second separator overhead stream 54*b*, as shown in FIG. 3, or for cooling and at least partially condensing third inlet feed stream 20*c*, as shown in FIG. 5.

Reflux separator 60 is used for separating second separator overhead stream 54*b* into a reflux separator overhead stream 66 and a reflux separator bottoms stream 62, as shown in FIG. 3. Reflux separator 60 can also be used for separating third inlet feed stream 20*c* into reflux separator overhead stream 66 and a reflux separator bottoms stream 62, as shown in FIG. 5.

Third cooler, or reflux condenser, 80 is used for cooling and substantially condensing reflux separator overhead stream 66. First heater 80 is used for warming demethanizer overhead stream 78. Third cooler and first heater 80 can be a common heat exchanger that is used to simultaneously provide cooling for reflux separator overhead stream 66 and to provide heating for demethanizer overhead stream 78. Booster compressor 102 is used for compressing demethanizer overhead stream 78 to produce a residue gas stream 120.

The apparatus embodiments of the present invention can also include a residue compressor 110 and a fourth cooler, or air cooler, 112. Residue compressor 110 is used to boost the pressure of the residue gas stream further, as described previously. Hot residue gas stream 120 is cooled in air cooler 112 and sent as product residue gas stream 114 for further processing.

The present invention can also include a first expansion valve 130, a second expansion valve 140, and a third expansion valve 150. Expansion valve 130 can be used to expand separator bottoms stream 52 to produce first, or bottom, tower feed stream 53. Expansion valve 140 can be used to expand reflux separator bottoms stream 62 to produce as third, or upper middle, tower feed stream 64. Expansion valve 150 can be used to expand reflux separator overhead stream 66 to produce fourth tower feed stream 68. A fourth expansion valve 160, as shown in FIGS. 3 and 5, can also be included for expanding at least a portion of the cooled residue gas reflux stream 122 to produce demethanizer reflux stream 126. In all embodiments of the present invention, each of the expansion valves can be any device that is capable of expanding the respective process stream. Examples of suitable expansion devices include a control valve and an expander. Other suitable expansion devices will be known to those of ordinary skill in the art and are to be considered within the scope of the present invention.

In all embodiments of the present invention, demethanizer 70 can be a reboiled absorber. In some embodiments of the present invention, cold separator 50 can be a cold absorber 50', as shown in FIG. 7. In all embodiments of the present invention, cold separator 50 can include a packed bed, or mass transfer zone. Other examples of suitable mass transfer zones include a tray or similar equilibrium separation stage or a flash vessel. Other suitable mass transfer zones will be known to those of ordinary skill in the art and are considered to be within the scope of the present invention. If a mass transfer zone is provided, the alternate feed arrangement illustrated in FIG. 7 can be utilized.

As an example of the present invention, an untreated feed gas can be utilized that contains up to 5.5 times greater the amount of $CO_2$ than suitable feed gases for prior art processes. Utilizing an untreated feed gas containing a greater amount of $CO_2$ results in substantial operating and capital cost savings because of the elimination or substantial reduction in the $CO_2$ removal costs associated with treating a feed gas stream.

As another advantage of the present invention, when compared with other prior art processes that utilize a residue gas recycle stream, the present invention is more economical to operate in that the process is optimized to take advantage of the properties associated with the residue recycle stream while simultaneously combining the stream with other reflux streams, such as a side stream of a feed gas stream. The size of the residue recycle stream is thereby reduced, but is able to take advantage of the desirable properties associated with such stream, i.e. the stream is lean and can be used to achieve high ethane recoveries.

While the invention has been shown or described in only some of its forms, it should be apparent to those skilled in the art that it is not so limited, but is susceptible to various changes without departing from the scope of the invention. For example, expanding steps, preferably by isentropic expansion, may be effectuated with a turbo-expander, Joule-Thompson expansion valves, a liquid expander, a gas or vapor expander or like.

We claim:

1. A process for separating a gas stream containing methane and ethane, ethylene, propane, propylene and heavier components into a volatile gas fraction containing a substantial amount of methane and a less volatile fraction containing a large portion of ethane, ethylene, propane, propylene and heavier components, the process comprising the steps of:

a. splitting a hydrocarbon feed stream into a first inlet stream, a second inlet stream and a third inlet stream and cooling the first, second, and third inlet streams;

b. supplying the first inlet stream and the second inlet stream to a cold separator;

c. separating the first inlet stream and the second inlet stream to produce a first vapor stream and a first liquid stream;

d. expanding the first vapor stream to produce an expanded first vapor stream and then supplying a demethanizer with the first liquid stream as a first tower feed stream and the expanded first vapor stream as a second tower feed stream;

e. cooling and at least partially condensing the third inlet stream and then supplying a reflux separator with the third inlet stream and producing a reflux separator overhead stream and a reflux separator bottoms stream;

f. supplying the demethanizer with the reflux separator bottoms stream as a third tower feed stream;

g. cooling and substantially condensing and then supplying the demethanizer with the reflux separator overhead stream as a fourth tower feed stream, the demethanizer producing a demethanizer overhead stream containing a substantial amount of methane and lighter components and a demethanizer bottoms stream containing a major portion of recovered ethane, ethylene, propane, propylene and heavier components;

h. warming and compressing the demethanizer overhead stream to produce a residue gas stream; and i. wherein an improvement comprises removing at least a portion of the residue gas stream as a residue gas reflux stream and cooling, substantially condensing and then supplying the residue gas reflux stream to the demethanizer as a reflux stream.

2. The process of claim 1, wherein the step of supplying the first inlet stream and the second inlet stream to a cold separator includes supplying a top of a cold absorber with the first inlet stream and a bottom of the cold absorber with the second inlet stream where the first inlet stream has a temperature colder than the second inlet stream, the cold absorber having a packed bed contained therein.

3. The process of claim 1, further including subcooling and supplying at least a portion of the first liquid stream to the demethanizer at a feed location located above that of the expanded first separator overhead stream.

4. The process of claim 1, wherein the steps of supplying the demethanizer with the first, second, third and fourth tower feed streams includes sending the first tower feed stream at a lowest feed location, sending the second tower feed stream at a second tower feed location that is higher than the lowest feed location, sending the third tower feed stream at a third tower feed location that is higher than the second tower feed location, and sending the fourth tower feed stream at a fourth tower feed location that is higher than the third tower feed location.

* * * * *